US005316789A

United States Patent [19]

Ookuma et al.

[11] Patent Number: 5,316,789

[45] Date of Patent: May 31, 1994

[54] METHOD OF WATER-PROOFING A CONNECTED PORTION OF ELECTRIC WIRES

[75] Inventors: Yasuyuki Ookuma; Fujio Ogawa; Yoshiyuki Hattori; Takamichi Miyamukai; Takayuki Sakakura, all of Mie, Japan

[73] Assignee: Sumitomo Wiring Systems, Ltd., Mie, Japan

[21] Appl. No.: 878,688

[22] Filed: May 5, 1992

[30] Foreign Application Priority Data

May 9, 1991 [JP] Japan ..... 3-133566

[51] Int. Cl.[5] ..... B05D 5/12

[52] U.S. Cl. ..... 427/117; 427/178; 156/185

[58] Field of Search ..... 156/53, 49, 54, 55, 156/185; 427/178, 117

[56] References Cited

U.S. PATENT DOCUMENTS

| | | | |
|---|---|---|---|
| 4,269,894 | 5/1981 | Sakai et al. | 156/53 X |
| 4,680,222 | 7/1987 | Anton | 156/53 X |
| 4,863,535 | 9/1989 | More | 156/55 X |
| 4,906,308 | 3/1990 | Mudgett | 156/53 |

FOREIGN PATENT DOCUMENTS

| | | |
|---|---|---|
| 2409989 | 9/1975 | Fed. Rep. of Germany . |
| 2624665 | 6/1989 | France . |
| 2028601 | 3/1980 | United Kingdom . |

*Primary Examiner*—Michael Lusignan

*Attorney, Agent, or Firm*—Sughrue, Mion, Zinn, Macpeak & Seas

[57] ABSTRACT

A method of water-proofing a connected portion of electric wires is disclosed which improves the efficiency of water-proofing and prevents the connected portion from becoming enlarged after working. An injector 10 filled with a water-proof insulation adhesion agent 11 is disposed above a tapping roll 7 of a known tape winder so that a nozzle 9 of the injector 10 is directed to the roll 7. A water-proof sheet 1 cut in a desired size is fed on the tapping roll 7. A predetermined amount of the adhesion agent is dropped on the sheet 1 from the nozzle 9 to form a deposit 2 of the adhesion agent. A supplementary sheet 4 made of a water-proof insulation material is applied to the connected portion 3 and then the connected portion 3 with the supplementary sheet 4 is put on the deposit 2 to form a sandwich type construction in which the portion 3 is disposed between the sheets 1 and 4. Then, the connected portion 3 is pushed down into a slot 8 of the tapping roll 7. The sheets 1 and 4 are wound around the connected portion 3 to seal it by rotating the roll 7.

2 Claims, 6 Drawing Sheets

Fig. 4C
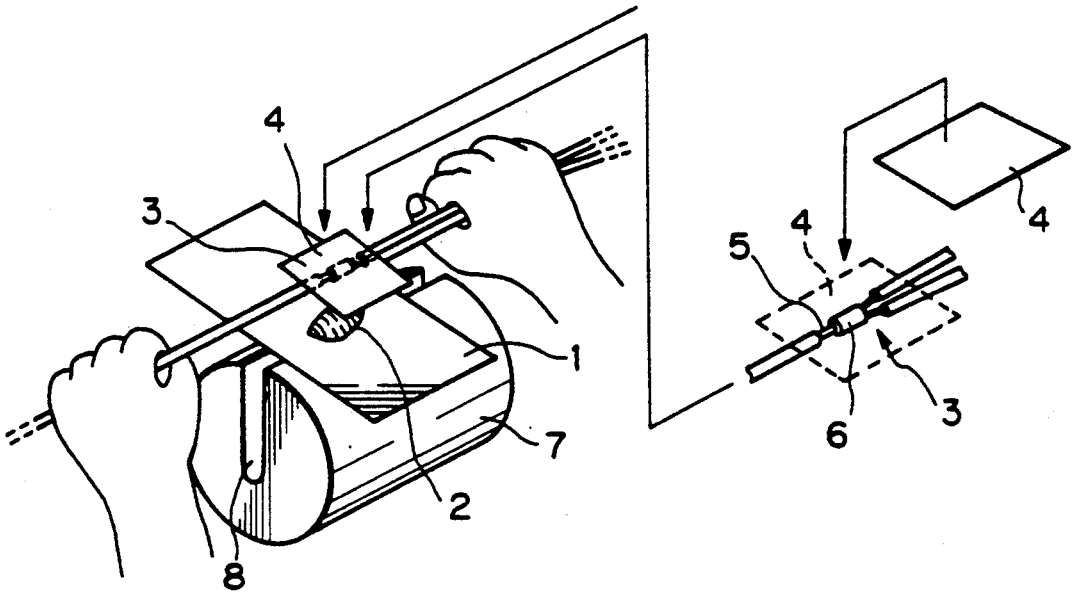
Fig. 4D
Fig. 4E
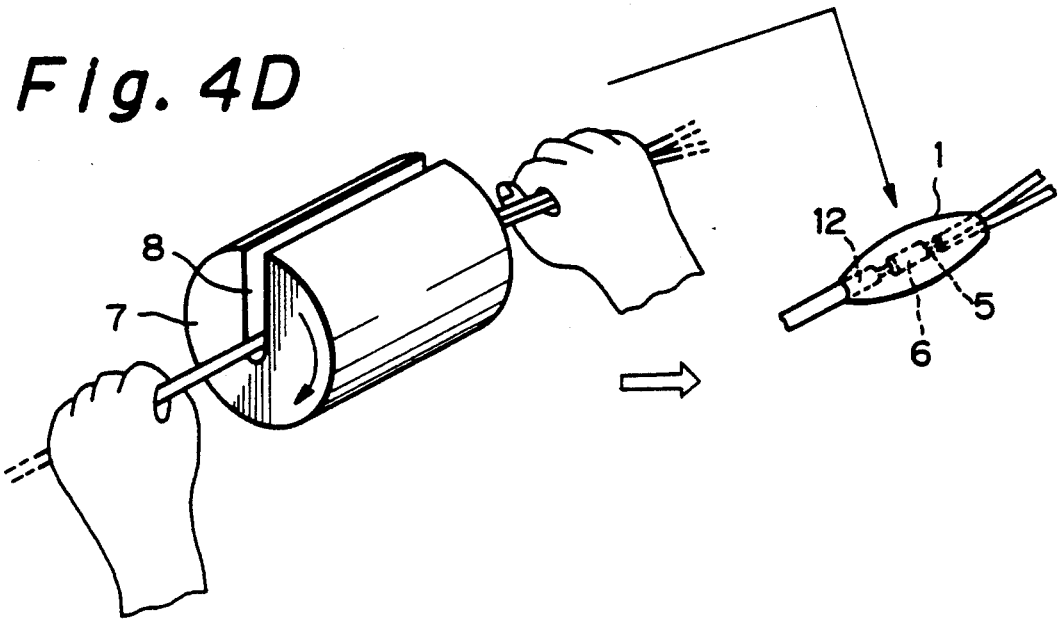

METHOD OF WATER-PROOFING A CONNECTED PORTION OF ELECTRIC WIRES

BACKGROUND OF THE INVENTION:

1. Field of the Invention

This invention relates to a method of water-proofing a connected portion of electric wires in, for example, a wire harness and the like in which stripped ends of the wires are directly coupled with each other.

2. Statement of the Prior Art

In a wire harness and the like, a connected portion of stripped ends of electric wires is subject to water erosion since a water-proof tape is merely wound around the connected portion and water is able to penetrate through gaps between turns of the wound tape into the connected portion by capillary action. In order to prevent water erosion, there are several methods of water-proofing the connected portion of electric wires.

For example, Japanese Patent Public Disclosure No. 64-6307 (1989) discloses a water-proof method in which a connected portion of electric wires is inserted in dies and melted rubber, plastic or the like is squeezed into the dies and hardened to embed the connected portion therein. Japanese Patent Publication No. 59-35510 (1984) discloses a water-proofing method in which a connected portion of electric wires is wound with a butyl rubber material and further wound by a tape or the connected portion is disposed between butyl rubber materials, then pressed by a press machine and further wound by a tape.

In addition, Japanese Utility Model Public Disclosure No. 62-123072 (1987) discloses a water-proofing method in which a connected portion of electric wires in covered with a thermal-shrinkage tube and the tube is heated to closely contact with the connected portion. Japanese Utility Model Public Disclosure No. 61-62376 (1986) discloses a water-proofing method in which a connected portion of electric wires is surrounded by split insulation covers, the covers are connected with each other at the abutted portion by an adhesive, and then bound with a belt.

Although the above prior art methods effect substantial water-proofing action, they have the following drawbacks. The method of 64-6307 requires a different die for each size and form of electric wire to be connected and high equipment costs for pressing and cooling processes. Further, the method comprises complicated steps and is difficult to work. Also, the method of 59-35510 makes the connected portion bulkier and heavier because it is covered with a butyl rubber material, which in turn requires additional time for pressing by a press machine or winding of tape.

In addition, in the method of 62-123072, it is difficult to pass the electric wire through the thermal-shrinkage tube, for example in the wire harness, and to effect mass production. The method of 61-62376 involves a high cost due to the provision of the insulation cover and makes the connected portion bulky.

SUMMARY OF THE INVENTION

An object of the present invention is to provide an efficient method of water-proofing a connected portion of electric wires.

Another object of the present invention is to provide a method of water-proofing a connected portion of stripped ends of electric wires, which does not result in the connected portion becoming overly bulky and which results in improved water-proofing.

In order to accomplish the above objects, a method of water-proofing a connected portion of electric wires in accordance with the present invention comprises the steps of:

dropping a predetermined amount of water-proof insulation adhesion agent on a water-proof sheet having a desired size and made of a water-proof insulation material to form a deposit of the sealing agent thereon;

embedding said connected portion into said deposit; and winding said water-proof sheet around said connected portion.

Another method of water-proofing a connected portion of electric wires in accordance with the present invention comprises the steps of:

dropping a predetermined amount of a water-proof insulation adhesion agent on a water-proof sheet having a desired size and made of a water-proof insulation material to form a deposit of the sealing agent thereon;

applying a supplementary sheet made of a water-proof insulation material on said connected portion of the electric wires;

embedding into said deposit said connected portion with said supplementary sheet so that said connected portion is disposed between said sheets; and winding said sheets round said connected portion.

In the method of the present invention, said step of dropping a predetermined amount of a water-proof insulation adhesion agent on the water-proof sheet further comprises the steps of:

arranging an injector of water-proof insulation adhesion agent above said water-proof sheet, said injector having a nozzle which ejects said adhesion agent by air pressure during up and down strokes;

converting the air pressure to pulsed positive and negative pressures;

dropping said adhesion agent to form the deposit on said water-proof sheet by the pulsed positive pressure during the down stroke of said nozzle; and controlling a bottom face of said adhesion in said injector by the pulsed negative pressure when stopping said dropping step during the up stroke of said nozzle.

The "connected portion of electric wires" described herein in connection with the present invention includes stripped ends and sheathed portions adjacent to the ends of the electric wires.

In the water-proofing method of the present invention, a predetermined amount of a water-proof insulation adhesion agent is dropped on the water-proof sheet to form a deposit of the sealing agent. The connected portion of the electric wires along with the supplementary sheet made of the water-proof insulation material being applied thereon is embedded into the deposit. Both sheets are wound around the connected portion to seal it. The sealing agent is solidified while embedding of the connected portion is carried out. Consequently, the connected portion is completely sealed.

The supplementary sheet prevents the sealing agent from dispersing or leaking from the sheet wound around the connected portion, prevents loss of the sealing agent, and enables the connected portion to be completely embedded in the sealing agent. The method also prevents the connected portion from becoming overly bulky.

Even if the size and/or a shape of the connected portion of the electric wires are changed, it is possible to accommodate the change by cutting the sheet into a desired size and controlling the drop of the sealing agent. Particular devices and dies such as a press, a heater, and the like are not required. It is possible to carry out the method of the present invention by utilizing a conventional common tape winder. Consequently, the water-proofing operation of the connected portion of the electric wires can be simplified.

Further, since the injector used in the present invention has a nozzle which ejects the adhesion agent under pulsed air pressure during up and down strokes and controls the bottom face of the adhesion agent by the pulsed negative pressure when stopping the dropping of the agent, strings of the adhesion agent pulled from the nozzle are broken during the up stroke. In addition, it is possible to prevent the adhesion agent from dripping out of the nozzle under gravity and to precisely control the dropping of the agent by the pulsed positive and negative pressures.

BRIEF DESCRIPTION OF THE DRAWINGS

FIGS. 4A, 4B, 4C, 4D and 4E are explanatory views illustrating a second embodiment of the water-proofing method in accordance with the present invention.

DETAILED DESCRIPTION OF THE PREFERRED EMBODIMENTS

Figure 1B:
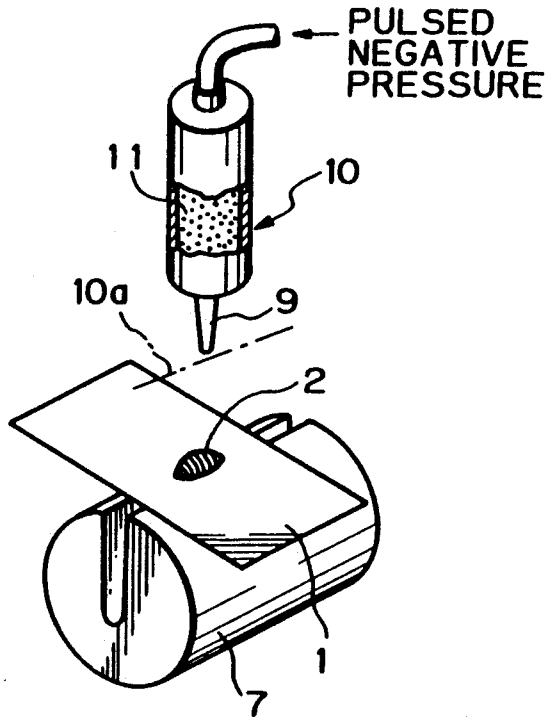
FIGS. 1A, 1B, 1C, 1D and 1E are explanatory views illustrating a first embodiment of a water-proofing method in accordance with the present invention.
Figure 1A:
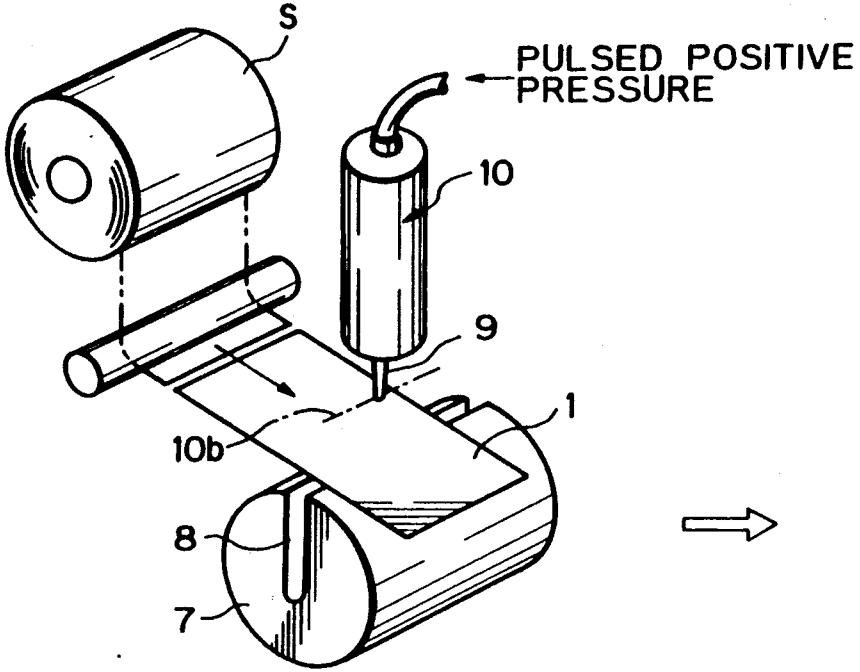
Figure 1C:
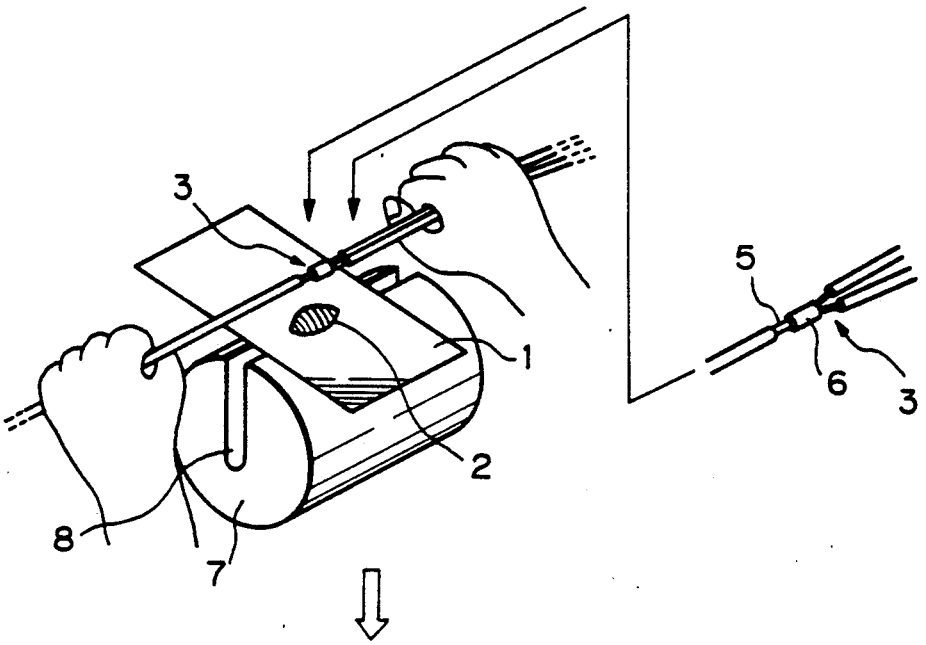
Figure 1D:
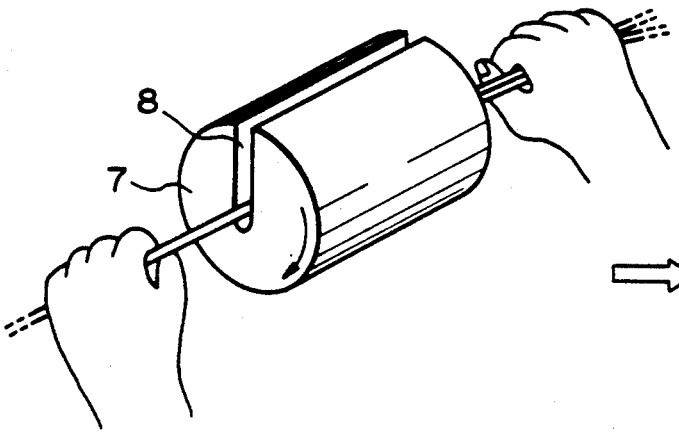
Figure 1E:
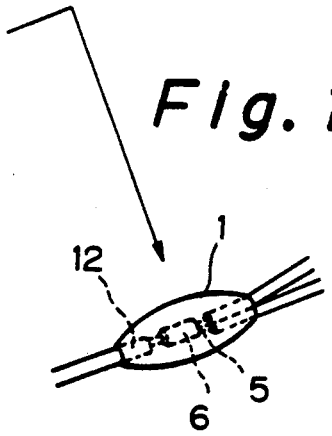

Referring now to FIG. 1A to FIG. 1E, FIG. 1E, FIG. 2, and FIG. 3, a first embodiment of a water-proofing method of a connected portion of electric wires in accordance with the present invention will be explained below.

An apparatus for carrying out the embodiment of the present invention includes a tape supply 5 and a taping roll 7. A tape is fed from the tape supply 5 and cut by a desired size to form a water-proof sheet 1. The sheet is fed onto the taping roll 7. Electric wires are put on the sheet 1 and they are pushed down into a slot 8 of the taping roll 7. Then, the sheet 1 is wound around the electric wires under rotation of the roll 7. These steps are carried out by a known tape winder. An injector 10 having a cassette type cylinder filled with a water-proof insulation adhesion agent 11 and a nozzle 9 is disposed above the taping roll 7 so that the nozzle 9 is directed to the roll 7.

Figure 3:
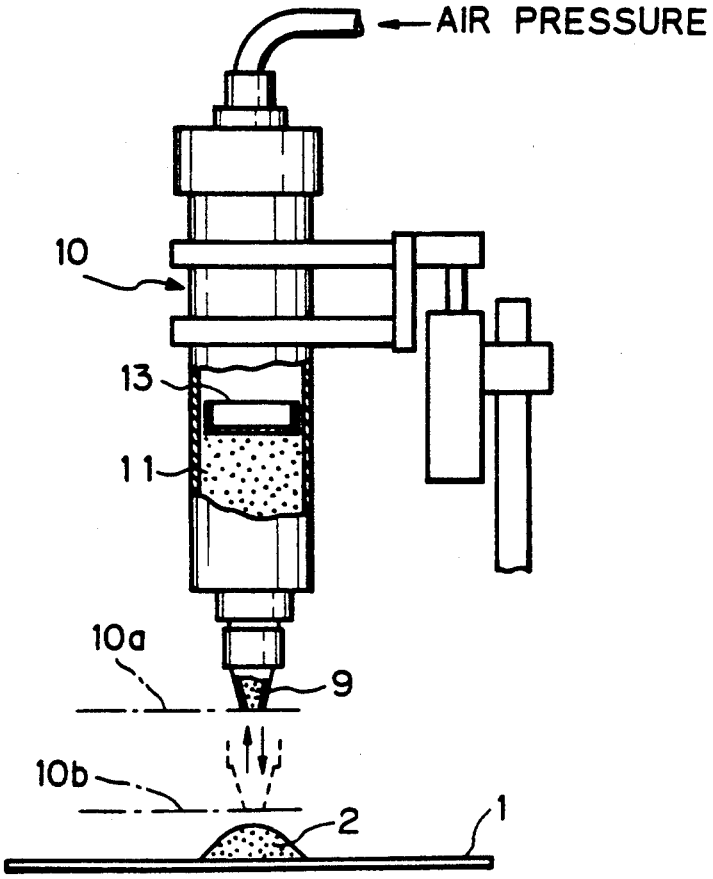
FIG. 3 is a side view of an injector used in the method of the present invention.
Figure 4B:
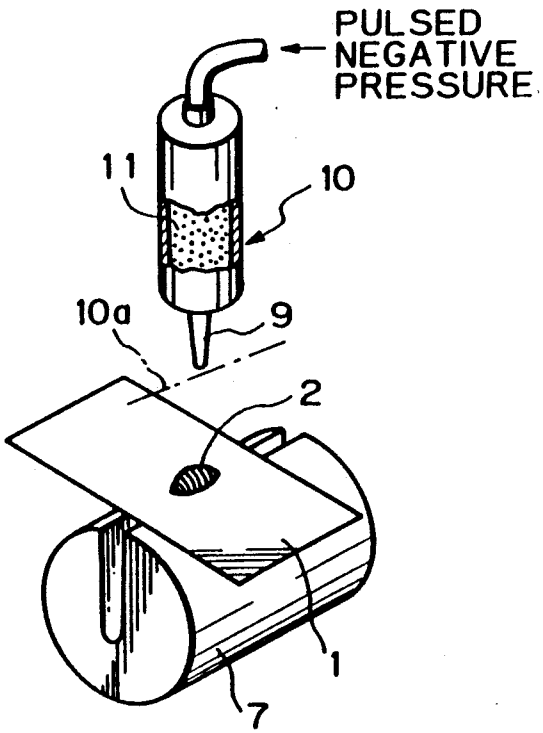
Figure 4A:
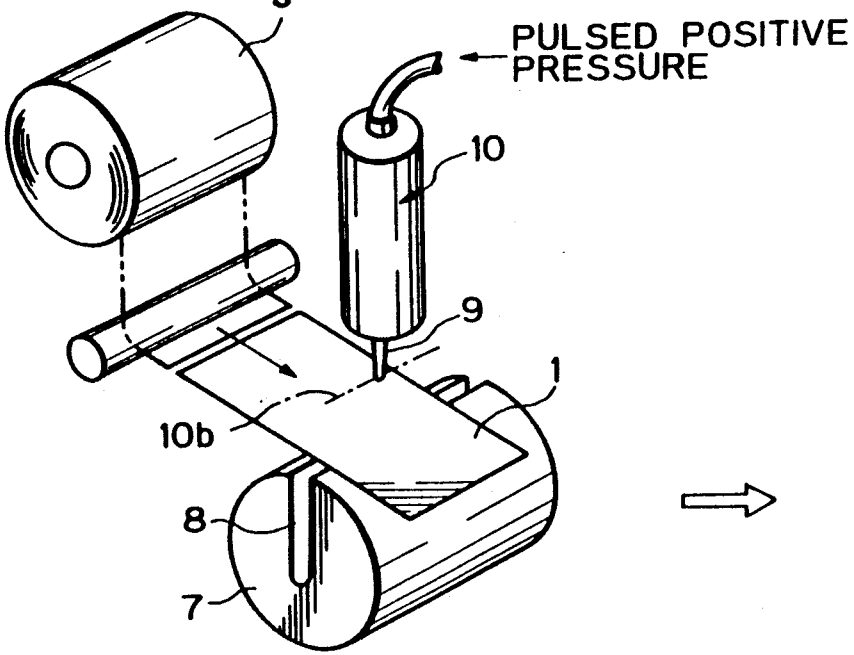

In the embodiment, the water-proof sheet 1 is cut from a water-proof insulation film and the adhesion agent ejected from the injector 10 is a silicone rubber material, which is partly solidified by moisture present in air in a few minutes, sold commercially under Parts No. SE 9176 by Toray-Dow Corning Silicone Corporation. Pulsed air pressure such as a positive ON-OFF pressure and a negative ON-OFF pressure are applied to the injector 10 through a control unit. The positive ON-OFF pressures serve to drop the adhesion agent and to stop the dropping thereof while the negative ON-OFF pressure controls an internal pressure in the injector 10. As shown in FIG. 3, the nozzle 9 of the injector 10 moves from an upper dead point **10*a* to a lower dead point 10*b* and vice versa. In FIG. 3, an actuating float 13 serves to push down the adhesion agent 11 by internal pressure in the injector 10**.

The water-proofing is carried out below by the above-described apparatus. When the water-proof sheet 1 cut to a given size is fed on the taping roll 7, a predetermined amount of an adhesion agent is dropped on the center of the sheet 1 from the nozzle 9 at the lower dead point **10*b* to form the sealing deposit 2. The nozzle 9 of the injector 10 is moved to the upper dead point 10*a* immediately before finishing dropping of the agent while strings of adhesion agent which are pulled between the nozzle 9 and the sealing deposit 2** due to a high viscosity of the agent are broken. Consequently, a space necessary for proceeding with the next step is maintained above the sealing deposit.

On the other hand, the stripped ends 5 of the electric wires are connected with each other by a coupling member 6 to form the connected portion 3. The connected portion 3 is pressed on the sealing deposit 2 provided on the water-proof sheet 1 and embedded into the deposit 2. While continuing to push down the connected portion 3, it is inserted into the slot 8 of the taping roll 7 together with the sheet 1. Several turns of the taping roll 7 cause the sheet 1 to be wound around the connected portion 3 including the stripped ends 5 and sheathed portions 12 adjacent to the ends 5 to complete the water-proofing operation.

When the nozzle 9 of the injector 10 returns to the upper dead point **10*a* the injector 10 is in a standby position for dropping the adhesion agent in the next cycle. At this time, pulsed internal pressures such as ON-OFF negative pressures with short intervals are applied to the injector 10 to prevent the adhesion agent 11 from dripping out of the nozzle 9 and to maintain the bottom face of the adhesion at a constant level in the enjector 10**.

Figure 2:
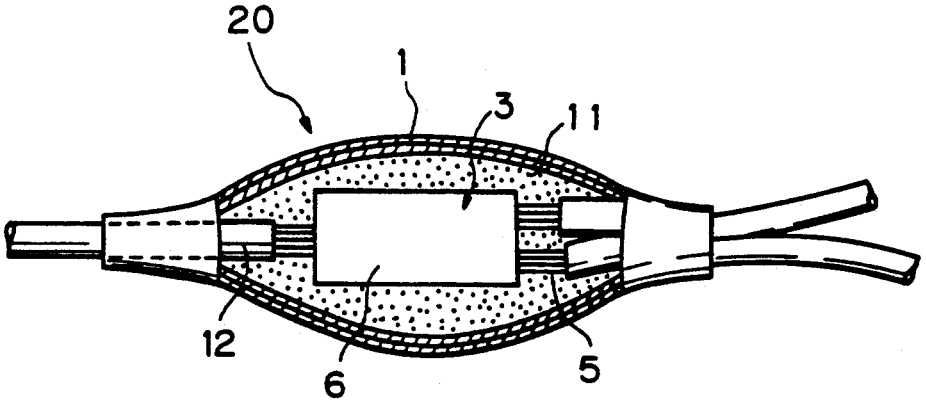
FIG. 2 is a cross sectional view of a water-proofed connected portion of electric wires shown in FIG. 1E.

Thus, as shown by reference member 20 in FIG. 2, the connected portion 3 including the stripped ends 5, coupling member 6, and adjacent to sheathed portion 12 is embedded and solidified in the adhesion agent 11 and the sheet 1 wound around the connected portion effects a complete double water-proofing.

In the above embodiment, the up and down movements and the control of the internal pressure by the ON-OFF negative pressure of the injector cause the string of the adhesion to be rapidly cut after dropping while the pulsed negative pressures control the level of the bottom face of the adhesion agent to improve an accuracy of dropping the agent. Accordingly, it is possible to drop the adhesion agent 11 in proper quantities, to provide a settled water-proof action, to prevent a loss of the adhesion agent, and to shorten intervals of the working cycle due to cutting of strings at an early stage.

Referring now to FIG. 4A to FIG. 4E, FIG. 5, and FIG. 3, a second embodiment of a water-proofing method of a connected portion of electric wires in accordance with the present invention will be explained below.

In this invention, a supplementary water-proof sheet 4 (made of a water-proof insulation material) having a smaller size than that of the water-proof sheet 1 is applied on the connected portion 3 in which the stripped ends 5 of the electric wires are connected with each other by the coupling member 6. The connected portion 3 with the sheet 4 is pressed on the sealing deposit 2 on the sheet 1 until the connected portion 3 under the sheet 4 is embedded in the deposit 2 to form a sandwich construction in which the connected portion 3 is disposed between the sheets 1 and 4. The other steps in the second embodiment are the same as those in the first embodiment.

Figure 5:
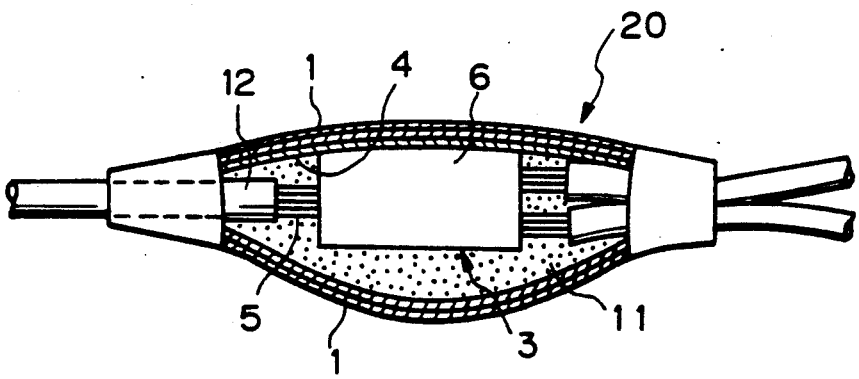
FIG. 5 is a cross sectional view of a water-proofed connected portion of electric wires shown in FIG. 4E.

Thus, as shown by a reference member 20 in FIG. 5, the connected portion 3 including the stripped ends 5, coupling member 6, and adjacent sheathed portion 12 is embedded and solidified in the adhesion agent 11 and the sheets 1 and 4 wound around the connected portion effect a complete double water-proofing.

It will be apparent from the foregoing description that the method of water-proofing the connected portion of electric wires assures a necessary and sufficient water-proofing function, simplifies a working process, enables all steps to be carried out by utilizing a conventional tape winder without requiring any special working machines such as a press, a heater and the like on any water-proof member such as a casing and the like, and enables the process to be effected at low cost and with high efficiency. In addition, it is possible to prevent the connected portion from becoming enlarged, to accommodate different sizes and shapes of connected portions of electric wires, and can be effectively employed in a wire harness production line and the like.

What is claimed is:

1. A method of water-proofing a connected portion of electric wires, said connected portion including stripped ends and sheathed portions adjacent to ends of the electric wires, said method comprising the steps of:

dropping an amount of a water-proof insulation adhesion sealing agent, sufficient to seal said connected portion of the electric wires, onto a water-proof sheet having a desired size and made of a water-proof insulation material to form a deposit of the sealing agent thereon;

embedding said connected portion in said deposit; and winding said water-proof sheet around said connected portion, wherein said step of dropping the water-proof insulation adhesion sealing agent onto the water-proof sheet further comprises the steps of:

arranging an injector of the water-proof insulation adhesion sealing agent above said water-proof sheet, said injector having a nozzle which ejects said adhesion sealing agent by air pressure during up and down strokes;

converting the air pressure to pulsed positive and negative pressures;

dropping said adhesion sealing agent to form a deposit on said water-proof sheet by pulsed positive pressure during a down stroke of said nozzle; and controlling a bottom face of said adhesion sealing agent in said ejector by pulsed negative pressure when stopping said dropping step during an up stroke of said nozzle.

2. A method of water-proofing a connected portion of electric wires, said connected portion including stripped ends and sheathed portions adjacent to ends of the electric wires, said method comprising the steps of:

dropping an amount of a water-proof insulation adhesion sealing agent, sufficient to seal said connected portion of the electric wires, onto a water-proof sheet having a desired size and made of a water-proof insulation material to form a deposit of the sealing agent thereon;

applying a supplementary sheet made of a water-proof insulation material on said connected portion of the electric wires;

embedding into said deposit said connected portion with said supplementary sheet so that said connected portion is disposed between said sheets; and winding said sheets around said connected portion, wherein said step of dropping the water-proof insulation adhesion sealing agent on the water-proof sheet further comprises the steps of:

arranging an injector of the water-proof insulation adhesion sealing agent above said water-proof sheet, said injector having a nozzle which ejects said adhesion sealing agent by air pressure during up and down strokes;

converting the air pressure to pulsed positive and negative pressures;

dropping said adhesion sealing agent to form a deposit on said water-proof sheet by pulsed positive pressure during the down stroke of said nozzle; and controlling a bottom face of said adhesion sealing agent in said ejector by pulsed negative pressure when stopping said dropping step during an up stroke of said nozzle.

* * * * *